US008151888B2

(12) United States Patent
Wright et al.

(10) Patent No.: US 8,151,888 B2
(45) Date of Patent: Apr. 10, 2012

(54) WELL TOOL WITH COMBINED ACTUATION OF MULTIPLE VALVES

(75) Inventors: Adam D. Wright, Al Khobar (IL); Adam H. Martin, Addison, TX (US); Paul D. Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 173 days.

(21) Appl. No.: 12/410,785

(22) Filed: Mar. 25, 2009

(65) Prior Publication Data

US 2010/0243259 A1 Sep. 30, 2010

(51) Int. Cl.
*E21B 34/12* (2006.01)

(52) U.S. Cl. ..... 166/332.3; 166/334.2; 166/332.7

(58) Field of Classification Search ..... 166/332.7, 166/334.23, 332.1–332.3, 334.2
See application file for complete search history.

(56) References Cited

U.S. PATENT DOCUMENTS

| | | | | |
|---|---|---|---|---|
| 3,092,135 | A | 6/1963 | Brown et al. | |
| 3,494,419 | A * | 2/1970 | Mullins | 166/150 |
| 3,533,430 | A | 10/1970 | Fredd | |
| 3,762,471 | A | 10/1973 | Mott | |
| 3,834,460 | A | 9/1974 | Brun et al. | |
| 4,025,883 | A | 5/1977 | Slade et al. | |
| 4,230,187 | A | 10/1980 | Seto et al. | |
| 4,347,900 | A | 9/1982 | Barrington | |
| 4,398,519 | A | 8/1983 | Tissot et al. | |
| 4,421,174 | A | 12/1983 | McStravick et al. | |
| 4,566,478 | A * | 1/1986 | Deaton | 137/112 |
| 4,633,952 | A | 1/1987 | Ringgenberg | |
| 4,658,904 | A | 4/1987 | Doremus et al. | |
| 4,848,472 | A | 7/1989 | Hopper | |
| 4,922,423 | A | 5/1990 | Koomey et al. | |
| 4,979,568 | A | 12/1990 | Spencer, III et al. | |
| 4,986,357 | A | 1/1991 | Pringle | |
| 5,050,681 | A | 9/1991 | Skinner | |
| 5,101,907 | A | 4/1992 | Schultz et al. | |
| 5,117,685 | A * | 6/1992 | Goldschild | 73/152.55 |
| 5,127,477 | A | 7/1992 | Schultz | |

(Continued)

FOREIGN PATENT DOCUMENTS

EP 0500341 B1 8/1992

(Continued)

OTHER PUBLICATIONS

Schlumberger IRIS Safety Valve Product Brochure, 2007, 1 page.

(Continued)

*Primary Examiner* — Giovanna Wright
(74) *Attorney, Agent, or Firm* — Marlin R. Smith

(57) ABSTRACT

A well tool with combined actuation of multiple valves. A well tool includes at least two valves and an actuator which actuates each of the valves, one valve being positioned longitudinally between the other valve and the actuator, and the other valve being operable in response to displacement of an operating device by the actuator. Another well tool includes a valve with a closure which displaces when the valve is operated, a volume of a chamber which increases and a volume of another chamber which decreases when the closure displaces, and a pressure differential between the chambers being substantially zero when the closure displaces. Another well tool includes at least two valve closures which are the only displaceable components of the well tool exposed to a first internal flow passage portion when one closure prevents fluid communication between the first and a second internal flow passage portions.

19 Claims, 16 Drawing Sheets

U.S. PATENT DOCUMENTS

| | | | | |
|---|---|---|---|---|
| 5,192,167 | A | 3/1993 | Da Silva et al. | |
| 5,234,057 | A | 8/1993 | Schultz et al. | |
| 5,238,070 | A | 8/1993 | Schultz et al. | |
| 5,251,703 | A | 10/1993 | Skinner | |
| 5,271,313 | A | 12/1993 | Lindegren, III | |
| 5,273,113 | A | 12/1993 | Schultz | |
| 5,412,568 | A | 5/1995 | Schultz | |
| 5,831,156 | A | 11/1998 | Mullins | |
| 5,890,542 | A | 4/1999 | Ringgenberg | |
| 6,085,845 | A * | 7/2000 | Patel et al. | 166/373 |
| 6,419,022 | B1 | 7/2002 | Jernigan et al. | |
| 6,422,315 | B1 | 7/2002 | Dean | |
| 6,450,258 | B2 | 9/2002 | Green et al. | |
| 6,536,530 | B2 | 3/2003 | Schultz et al. | |
| 6,622,799 | B2 | 9/2003 | Dean | |
| 6,782,952 | B2 | 8/2004 | Garay et al. | |
| 6,799,633 | B2 | 10/2004 | McGregor | |
| 6,917,857 | B2 | 7/2005 | Rentmeester et al. | |
| 7,011,289 | B2 | 3/2006 | Singh | |
| 7,082,994 | B2 | 8/2006 | Frost, Jr. et al. | |
| 7,111,675 | B2 | 9/2006 | Zisk, Jr. | |
| 7,140,436 | B2 | 11/2006 | Grant et al. | |
| 7,201,230 | B2 | 4/2007 | Schultz et al. | |
| 7,240,734 | B2 | 7/2007 | Nivens et al. | |
| 7,448,591 | B2 | 11/2008 | Ross | |
| 2004/0226720 | A1 | 11/2004 | Schultz et al. | |
| 2007/0029078 | A1 | 2/2007 | Wright et al. | |

FOREIGN PATENT DOCUMENTS

| | | | |
|---|---|---|---|
| EP | 0500343 | B1 | 8/1992 |
| EP | 0604156 | B1 | 6/1994 |
| WO | 03021075 | A1 | 3/2003 |

OTHER PUBLICATIONS

Schlumberger IRIS Dual Valve Product Brochure, 2007, 2 pages.
Schlumberger IRIS Pulse-operated fullbore tools Product Brochure, Oct. 2001, 8 pages.
Halliburton DynaLink™ Telemetry System Product Brochure, Jan. 2009, 2 pages.
Examination Report for GB0609150.8 issued Jun. 5, 2007, 1 page.
Examination Report for GB 0410709.0 issued Aug. 31, 2006, 1 page.
Search Report for GB 0410709.0 issued Aug. 18, 2004, 1 page.
Office Action issued Jul. 8, 2005, for U.S. Appl. No. 10/438,793, 14 pages.
Office Action issued Jun. 22, 2006, for U.S. Appl. No. 10/438,793, 6 pages.
Scott Rotary Seals Custom Products webpage, Nov. 14, 2007, 2 pages.
Scott Rotary Seals Product Family Introduction webpage, Nov. 27, 2007, 1 page.
U.S. Appl. No. 12/352,892, filed Jan. 13, 2009, 41 pages.
U.S. Appl. No. 12/352,901, filed Jan. 13, 2009, 35 pages.
Halliburton Express™ Circulating Valve Product brochure, undated, 2 pages.
Halliburton H04996 Omni™ Single-Trip Circulating Valve Product brochure, Jul. 2006, 2 pages.
Halliburton LPR-N™ Tester Valve Product brochure, undated, 2 pages.
Halliburton OMNI™ Circulating Valve Product brochure, undated, 1 page.
Halliburton Select Tester® Valve Product brochure, undated, 2 pages.
Office Action issued Dec. 16, 2010, for U.S. Appl. No. 12/352,892, 14 pages.
Office Action issued Jun. 30, 2001 for U.S. Appl. No. 13/021,624, 20 pages.
Office Action issued Jul. 28, 2011 for U.S. Appl. No. 12/352,901, 13 pages.
Office Action issued Jul. 19, 2011 for U.S. Appl. No. 12/352,892, 6 pages.
Office Action issued Mar. 7, 2011, for U.S. Appl. No. 12/352,901, 21 pages.

* cited by examiner

WELL TOOL WITH COMBINED ACTUATION OF MULTIPLE VALVES

BACKGROUND

This disclosure relates generally to equipment utilized and operations performed in conjunction with a subterranean well and, in an example described below, more particularly provides a well tool with combined actuation of multiple valves.

It is known to operate multiple valves, for example, in formation testing operations to provide for shut-in, circulating and flow portions of a test. Unfortunately, however, such operation of multiple valves has in the past typically required complex actuation mechanisms, multiple actuation mechanisms and/or actuation mechanisms prone to fouling by debris which accumulates in an interior of the valves while they are closed.

Therefore, it will be appreciated that improvements are needed in the art of actuating well tools having multiple valves.

SUMMARY

In the disclosure below, well tools are provided with features which solve at least one problem in the art. One example is described below in which a well tool actuator is capable of reliably operating multiple valves. Another example is described below in which the actuator and its moving components are isolated from a debris-laden portion of an internal flow passage.

In one aspect, the present disclosure provides to the art a well tool which includes at least two valves and an actuator which actuates each of the valves between open and closed configurations thereof. One valve is positioned longitudinally between the other valve and the actuator, with the valve opposite the actuator from the first valve being operable in response to displacement of an operating device by the actuator.

In another aspect, a well tool is provided which includes a valve with a closure which displaces when the valve is operated between its open and closed configurations. A volume of a first chamber increases and a volume of a second chamber decreases when the closure displaces. A pressure differential between the first and second chambers is substantially zero when the closure displaces.

In yet another aspect, a well tool is provided which includes an interior flow passage extending through the well tool. A valve selectively permits and prevents fluid communication between a first longitudinal portion of the interior flow passage and an exterior of the well tool, with the valve including a first closure. Another valve selectively permits and prevents fluid communication between the first portion and a second longitudinal portion of the interior flow passage, with the valve including a second closure. The first and second closures are the only displaceable components of the well tool exposed to the first flow passage portion when the second closure prevents fluid communication between the first and second flow passage portions.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
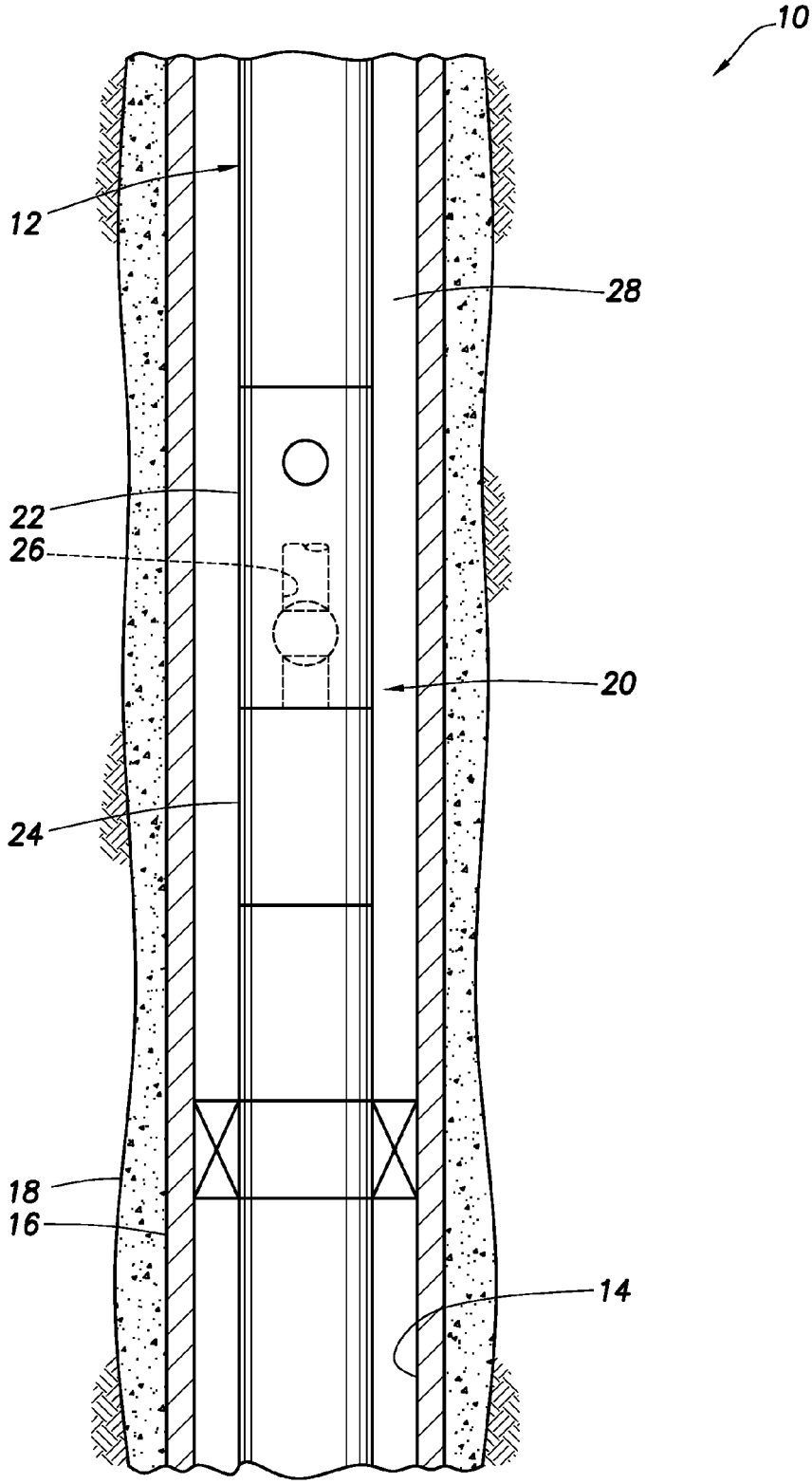
FIG. 1 is a schematic partially cross-sectional view of a well system embodying principles of the present disclosure.

Representatively illustrated in FIG. 1 is a well system 10 which embodies principles of this disclosure. In the system 10, a tubular string 12 (such as a drill string, production tubing string, injection string, etc.) has been installed in a wellbore 14 lined with casing 16 and cement 18. In other examples, the wellbore 14 could be uncased or open hole.

A well tool 20 is interconnected in the tubular string 12. The well tool 20 includes at least a valve section 22 and an actuator 24. As described more fully below, the actuator 24 is used to operate multiple valves of the valve section 22.

One of the valves is used to selectively permit and prevent fluid communication between an interior flow passage 26 extending longitudinally through the well tool 20 and the tubular string 12, and an annulus 28 formed radially between the tubular string and the wellbore 14. Another valve is used to selectively permit and prevent fluid communication between upper and lower portions of the flow passage 26.

In one unique feature of the system 10, the actuator 24 is positioned below the valve section 22, but the actuator is still capable of operating both of the valves. In another unique feature of the system 10, the actuator 24 does not have any moving parts which are exposed to the flow passage 26 above the valves when the valves are closed.

In this manner, debris which settles out above the valve which closes off the flow passage 26 does not hinder operation of the actuator 24. In the examples described more fully below, closures of the valves are the only displaceable components of the well tool 20 which are exposed to the flow passage 26 above the valve which closes off the flow passage.

In yet another unique feature of the well system 10, one of the valves includes a closure which is pressure balanced and volume balanced. This closure is also mostly isolated from the flow passage 26.

At this point it should be noted that the well system 10 depicted in FIG. 1 is merely one example of a wide variety of well systems which could incorporate the principles of this disclosure. For example, the wellbore 14 is not necessarily vertical as shown in FIG. 1, the wellbore is not necessarily cased or cemented, etc.

In addition, the well tool 20 could be used in other well systems in keeping with the principles of this disclosure. Use of the well tool 20 in formation testing operations is described below, but the well tool is not limited to use only in conjunction with formation testing operations.

Figure 2:
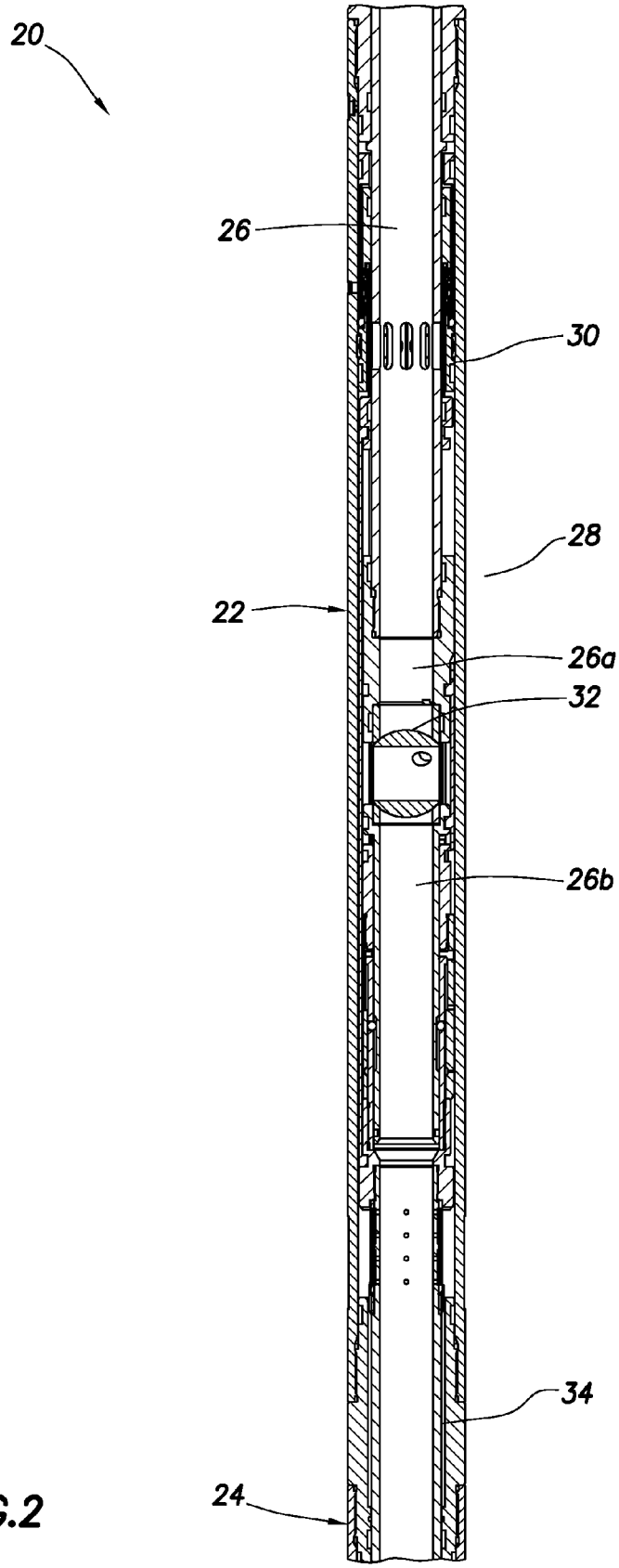
FIG. 2 is an enlarged scale schematic cross-sectional view of a well tool usable in the system of FIG. 1, the well tool embodying principles of the present disclosure.

Referring additionally now to FIG. 2, an enlarged scale cross-sectional view of the valve section 22 and an upper part of the actuator 24 is representatively illustrated. In this view it may be seen that the valve section 22 includes a sliding sleeve valve 30 and a ball valve 32.

The sleeve valve 30 is depicted in an open configuration in FIG. 2. In this configuration, fluid communication is permitted between the flow passage 26 and the annulus 28 external to the well tool 20. A sleeve-type closure of the valve 30 can be displaced by the actuator 24 to close the valve and thereby prevent fluid communication between the flow passage 26 and the annulus 28, as described more fully below.

The valve 32 is depicted in a closed configuration in FIG. 2. In this configuration, fluid communication is prevented between upper and lower portions 26*a,b* of the flow passage 26. A ball-type closure of the valve 32 can be displaced by the actuator 24 to open the valve and thereby permit fluid communication between the upper and lower portions 26*a,b* of the flow passage 26, as described more fully below.

Note that the actuator 24 is positioned below the valve section 22, and that the valve 32 is positioned between the actuator and the other valve 30. With the actuator 24 positioned below the valve 32, debris which accumulates in the flow passage portion 26*a* above the valve when it is closed does not come into contact with any moving parts of the actuator. Furthermore, the closures of the valves 30, 32 are the only displaceable components of the valve section 22 which are exposed to the upper flow passage portion 26*a* when the valve 32 is closed, thereby minimizing the risk of malfunction of the valves.

In this example, the actuator 24 may be of the type described in copending U.S. application Ser. No. 12/352,901, filed on Jan. 13, 2009. The actuator 24 may be controlled using an electro-hydraulic controller of the type described in copending U.S. application Ser. No. 12/352,892, filed on Jan. 13, 2009. The entire disclosures of these prior applications are hereby incorporated by this reference. However, other types of actuators and controllers may be used, without departing from the principles of this disclosure.

In the actuator described in U.S. application Ser. No. 12/352,901 referenced above, an operating member 34 is displaceable to three separate longitudinal positions. The valve section 22 described herein can utilize those three longitudinal positions of the operating member 34 to operate the valves 30, 32 between their open and closed configurations.

Figure 3:
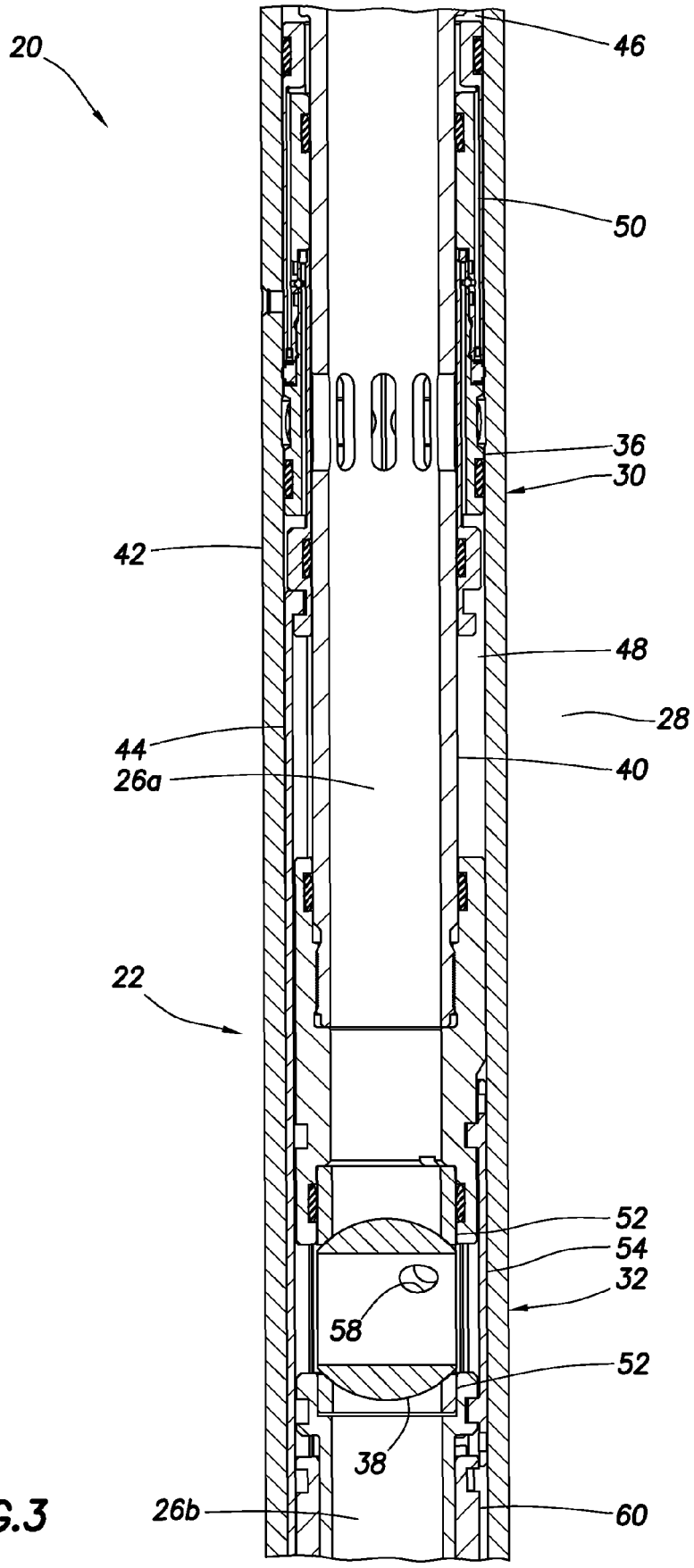
FIG. 3 is a further enlarged scale schematic cross-sectional view of a valve section of the well tool.

Referring additionally now to FIG. 3, a further enlarged scale cross-sectional view of the valve section 22 is representatively illustrated. In this view the sleeve closure 36 of the valve 30 and the ball closure 38 of the valve 32 can be seen in more detail.

The sleeve closure 36 is generally annular-shaped, and is sealingly and reciprocably received between an inner mandrel 40 and an outer housing 42. In its upper position as depicted in FIG. 3, the closure 36 permits fluid communication between the upper flow passage portion 26*a* and the annulus 28. However, when the operating member 34 is displaced downwardly, an elongated operating device 44 engaged with the closure 36 is also displaced downwardly, thereby preventing fluid communication between the flow passage 26 and the annulus 28.

The sleeve closure 36 separates two annular chambers 46, 48 formed radially between the inner mandrel 40 and outer housing 42. In one unique feature of the valve 30, the volumes of the chambers 46, 48 change as the closure 36 displaces, but the chambers are pressure-balanced (e.g., so that a pressure differential between the chambers is substantially zero) due to a passage 50 formed through the closure, which passage provides fluid communication between the chambers.

For example, as the closure 36 displaces downward as viewed in FIG. 3, the volume of the chamber 46 increases and the volume of the chamber 48 decreases, and vice versa as the closure displaces upward. Preferably, the chambers 4G, 48 are initially filled with a viscous lubricant (such as grease) at assembly, to help exclude debris from the chambers during operation.

Note that, although in this example longitudinal displacement of the sleeve closure 36 is used to open and close the valve 30, other types of displacement (such as rotational, helical, etc.) could be used if desired. Furthermore, it is not necessary for the closure 36 to be a sleeve or to be annular-shaped, since other types of closures and other types of valves may be used, without departing from the principles of this disclosure.

The ball closure 38 is rotated in order to selectively open and close the valve 32. The closure 38 rotates between annular-shaped seats 52 which are secured above and below the closure by C-shaped members 54. In this example, three equally circumferentially spaced members 54 are used (see FIG. 7), but other arrangements may be used if desired.

Operating members 56 include lobes which are engaged with openings 58 in the closure 38 (see FIG. 7), such that upward and downward displacement causes the closure to rotate between its closed and open positions. It is a substantial benefit of the configuration of the valve 32 described herein that all of the C-shaped members 54, the operating members 56 and the operating device 44 are accommodated in the narrow annular space formed radially between the closure 38 and the outer housing 42.

The operating members 56 are engaged with an operating sleeve 60 which is releasably secured to displace with the operating member 34 as described more fully below. In essence, the operating sleeve 60 and the operating members 56 displace with the operating member 34 between only two of its three positions.

With the valve 30 open and the valve 32 closed as depicted in FIG. 3, downward displacement of the operating member 34 from its upper position to its intermediate position will cause the closure 36 to displace to its closed position, but will not cause any displacement of the closure 38. However, further downward displacement of the operating member 34 from its intermediate to its lower position will cause the closure 38 to rotate to its open position. Upward displacement of the operating member 34 will cause the same displacements of the closures 36, 38 as described above, but in reverse.

Figure 4A:
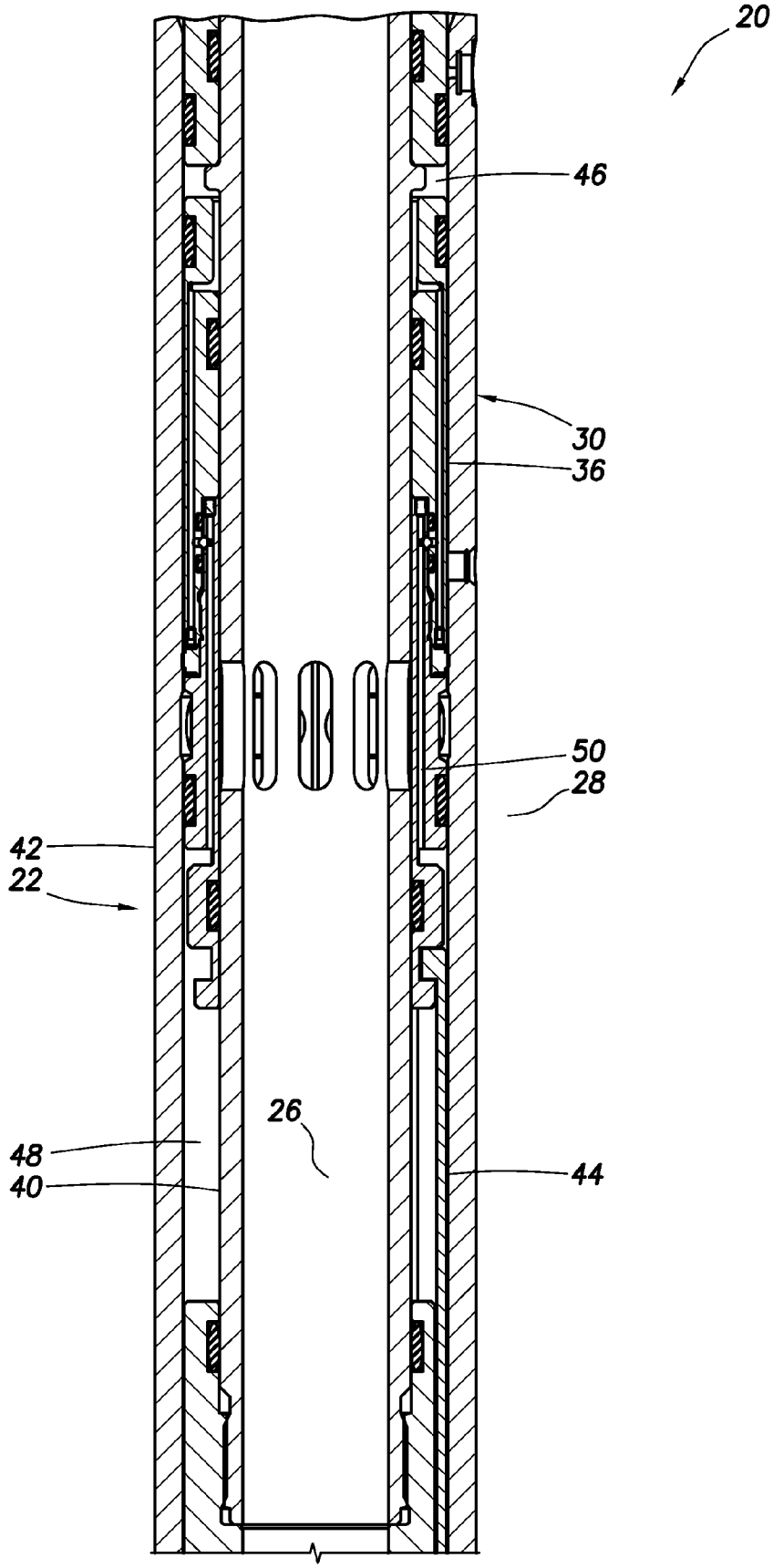
FIGS. 4A & B are further enlarged scale schematic cross-sectional views of the valve section in a circulate configuration.
Figure 4B:
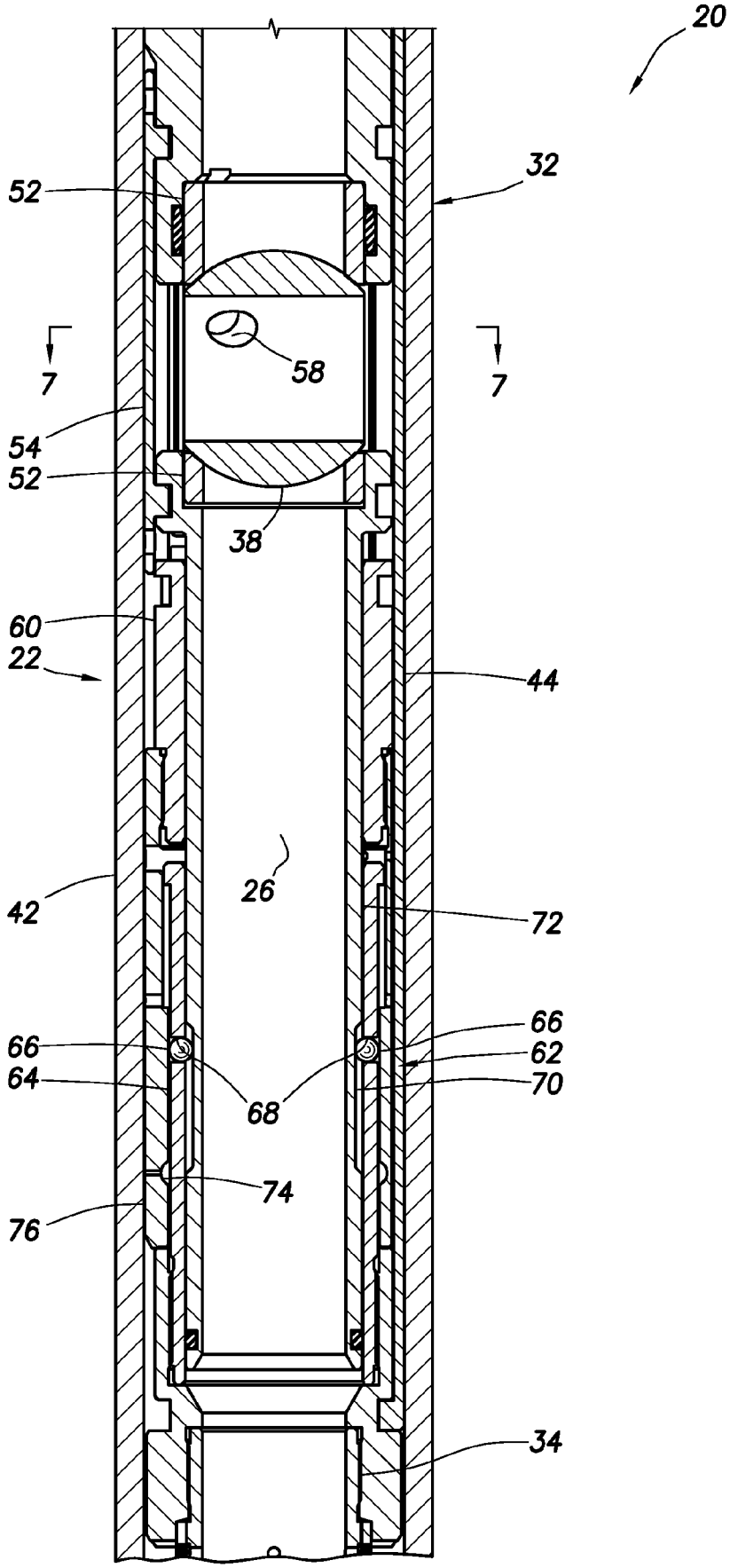

Referring additionally now to FIGS. 4A & B, a further enlarged scale cross-sectional view of the valve section 22 and the upper portion of the actuator 24 is representatively illustrated. In this view, further details of the valves 30, 32 can be clearly seen, along with details of a releasable locking device 62 which selectively permits and prevents relative displacement between the operating device 44 and the operating sleeve 60.

In the configuration of FIGS. 4A & B, the sleeve closure 36 is in its open position and the ball closure 38 is in its closed position, as in the views of FIGS. 2 & 3. However, when the operating member 34 displaces downward, the operating device 44 will also displace downward, which will cause the closure 36 to also displace downward. Thus, it will be appreciated that the operating device 44 provides a direct mechanical connection between the actuator 24 and the closure 36 longitudinally across the closure 38 of the valve 32.

The operating member 34 is also connected to a ball retainer sleeve 64 which retains balls 66 in openings 68 formed radially through the sleeve. The balls 66 are also received in a radially reduced recess 70 extending longitudinally along an inner mandrel 72 which also supports the lower seat 52 below the closure 38.

Figure 5A:
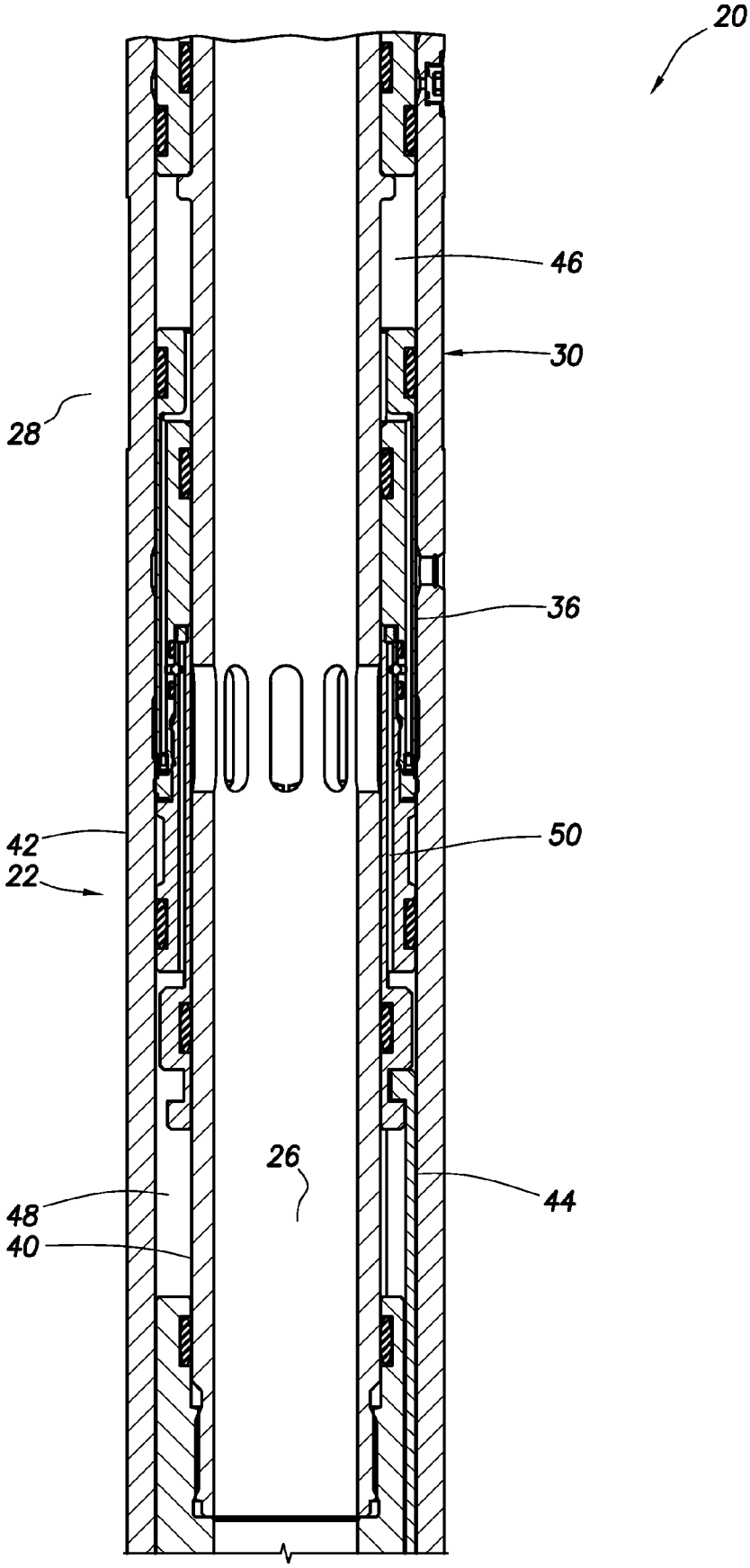
FIGS. 5A & B are schematic cross-sectional views of the valve section in a shut-in configuration.
Figure 5B:
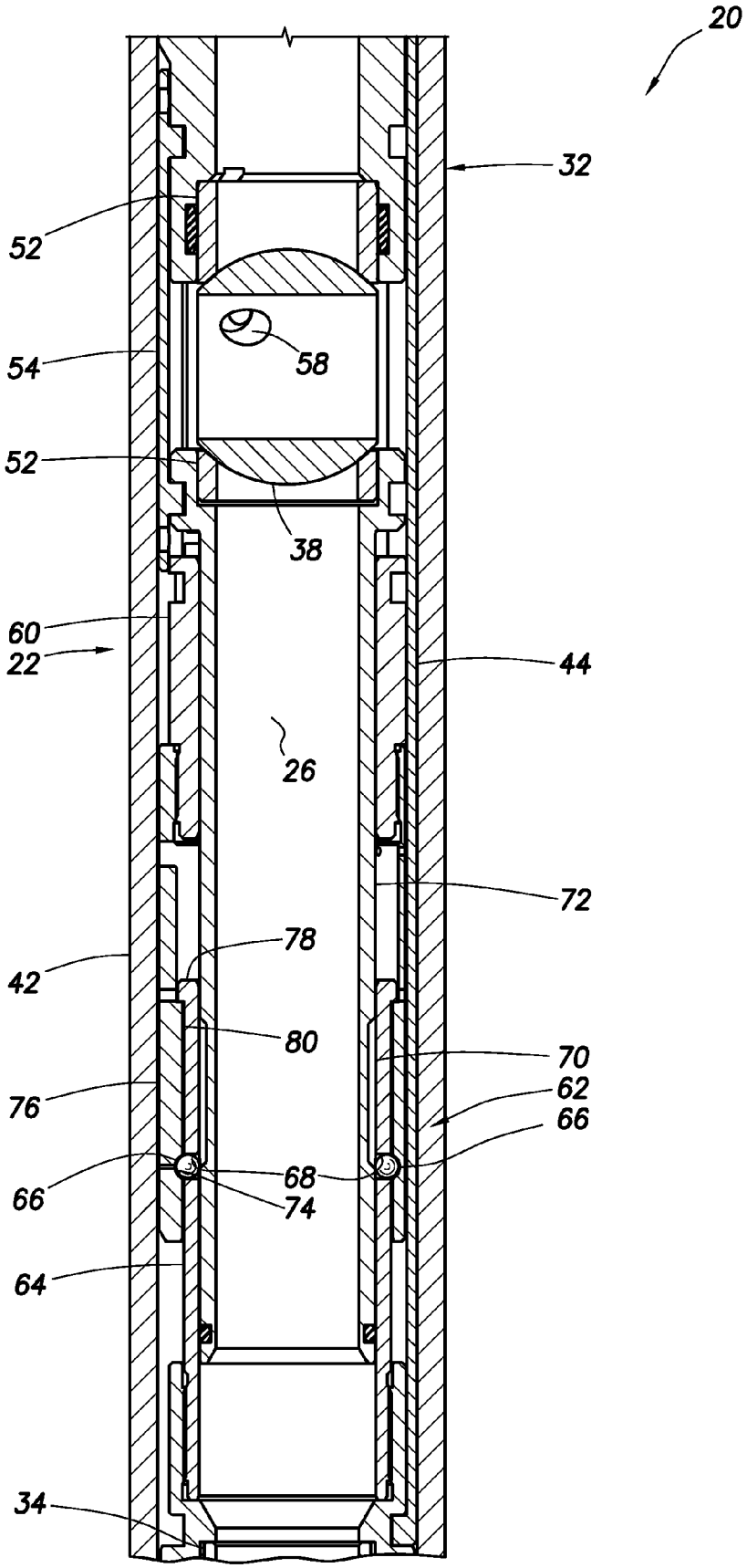

Referring additionally now to FIGS. 5A & B, the valve section 22 is representatively illustrated after the operating member 34 has displaced downwardly to its intermediate position, a sufficient distance to displace the closure 36 so that it now prevents fluid communication between the flow passage 26 and the annulus 28. Note that the closure 38 remains in its closed position, with no displacement of the closure 38 having been caused by the downward displacement of the operating member 34.

The balls 66, however, have reached the lower end of the recess 70 and are now displaced radially outward into engagement with a radially enlarged recess 74 formed in an operating device 76 which is connected to the operating sleeve 60. As described above, the sleeve 60 is engaged with the operating members 56, which are in turn engaged with the closure 38 for rotation thereof.

It will be appreciated that further downward displacement of the operating member 34 will cause downward displacement of the operating device 44, the retainer sleeve 64, the operating device 76 (due to engagement of the balls 66 with the recess 74), and the operating sleeve 60. Thus, the locking device 62 has now prevented relative displacement between the operating devices 44, 76 in the configuration of FIGS. 5A & B.

In addition, a radially enlarged upper end 78 of the retainer sleeve 64 has shouldered against a radially inwardly reduced lower end 80 of the operating device 76, thereby preventing downward displacement of the retainer sleeve 64 relative to the operating device 76. This shouldered engagement provides substantial strength for pulling the operating sleeve 60 downward to open the ball valve 32, to allow for the typically greater force required to open a closed ball valve than to close an open ball valve. The engagement between the balls 66 and the recess 68 does releasably secure the retainer sleeve 64 and operating device 76 against upward and downward displacement relative to each other, but the shouldered engagement between the retainer sleeve and operating device ensures that sufficient strength is available to downwardly displace the operating sleeve 60 when needed.

Note that downward displacement of the closure 36 of the valve 30 has decreased the volume of the chamber 48, but has increased the volume of the chamber 46. However, the chambers 46, 48 remain pressure balanced due to the fluid communication provided by the passage 50.

Figure 6A:
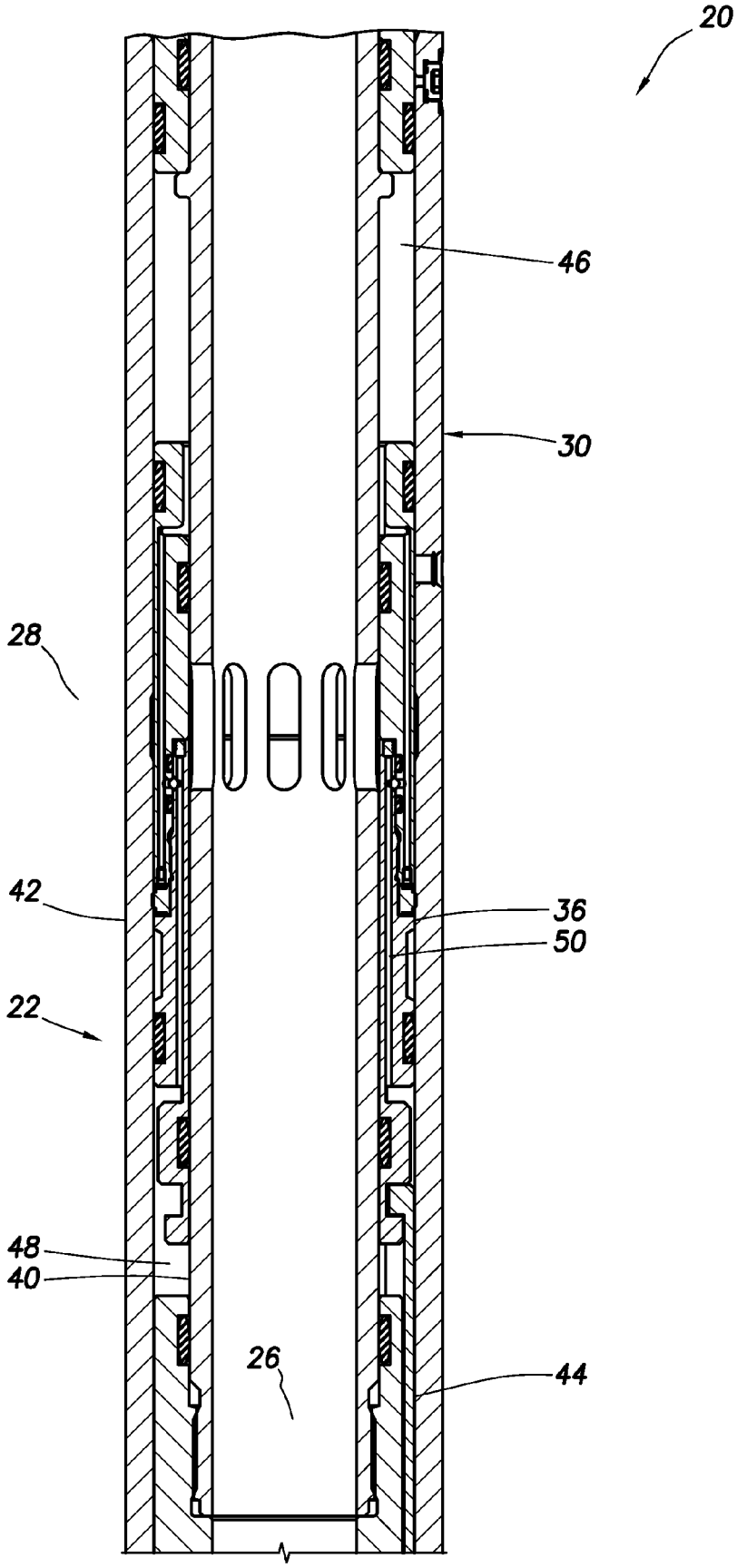
FIGS. 6A & B are schematic cross-sectional views of the valve section in a flow configuration.
Figure 6B:
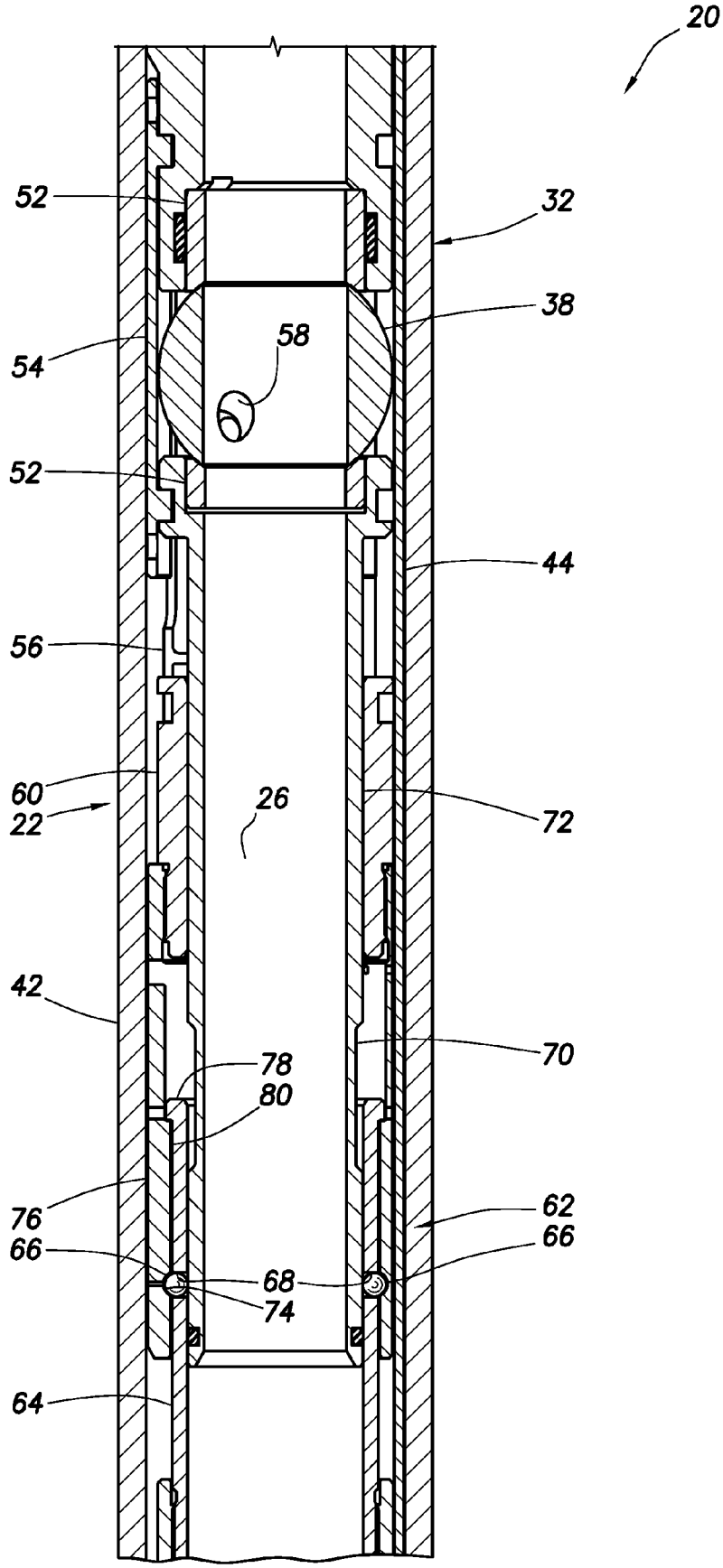

Referring additionally now to FIGS. 6A & B, the valve section 22 is representatively illustrated after the operating member 34 has displaced further downwardly from its intermediate position to its lower position. The operating sleeve 60 has, thus, been displaced downward, thereby opening the closure 38 to permit fluid communication through the flow passage 26.

The operation of the locking device 62 and operating devices 44, 76 mechanism just described allows functional advantage and safeguard with regard to conventional well testing in that the valve 30 will always assume a closed position, preventing fluid communication between the passage 26 and the annulus 28, prior to opening valve 32. This design safeguard eliminates the potential release of hydrocarbons into the annulus 28 and further contaminating of the reservoir when attempting to operate tools within the annulus (i.e., the tool will always have to move to the intermediate position in which both valves 30, 32 are closed, before it is capable of either opening the ball valve or circulating ports).

The locking device 62 continues to prevent relative displacement between the operating devices 44, 76 in the configuration of FIGS. 6A & B, due to engagement of the balls 66 in the recess 74. In addition, the shouldered engagement between the retainer sleeve 64 and the operating device 76 remains.

The operating device 44 has again displaced downwardly (as compared to the configuration of FIGS. 5A & B), thereby further downwardly displacing the sleeve closure 36, but the closure still prevents fluid communication between the flow passage 26 and the annulus 28. Also, the volume of the chamber 46 has again increased, and the volume of the chamber 48 has again decreased, due to downward displacement of the closure 36, but the chambers remain pressure balanced.

Note that some relatively small transient pressure differential between the chambers 46, 48 may be induced by displacement of the closure device 36 (due, for example, to a restriction to flow through the passage 50), but this pressure differential will preferably not be substantial. In addition, the displacement of the closure 36 is not caused by any pressure differential between the chambers 46, 48—instead, any pressure differential would be caused by displacement of the closure 36.

Figure 7:
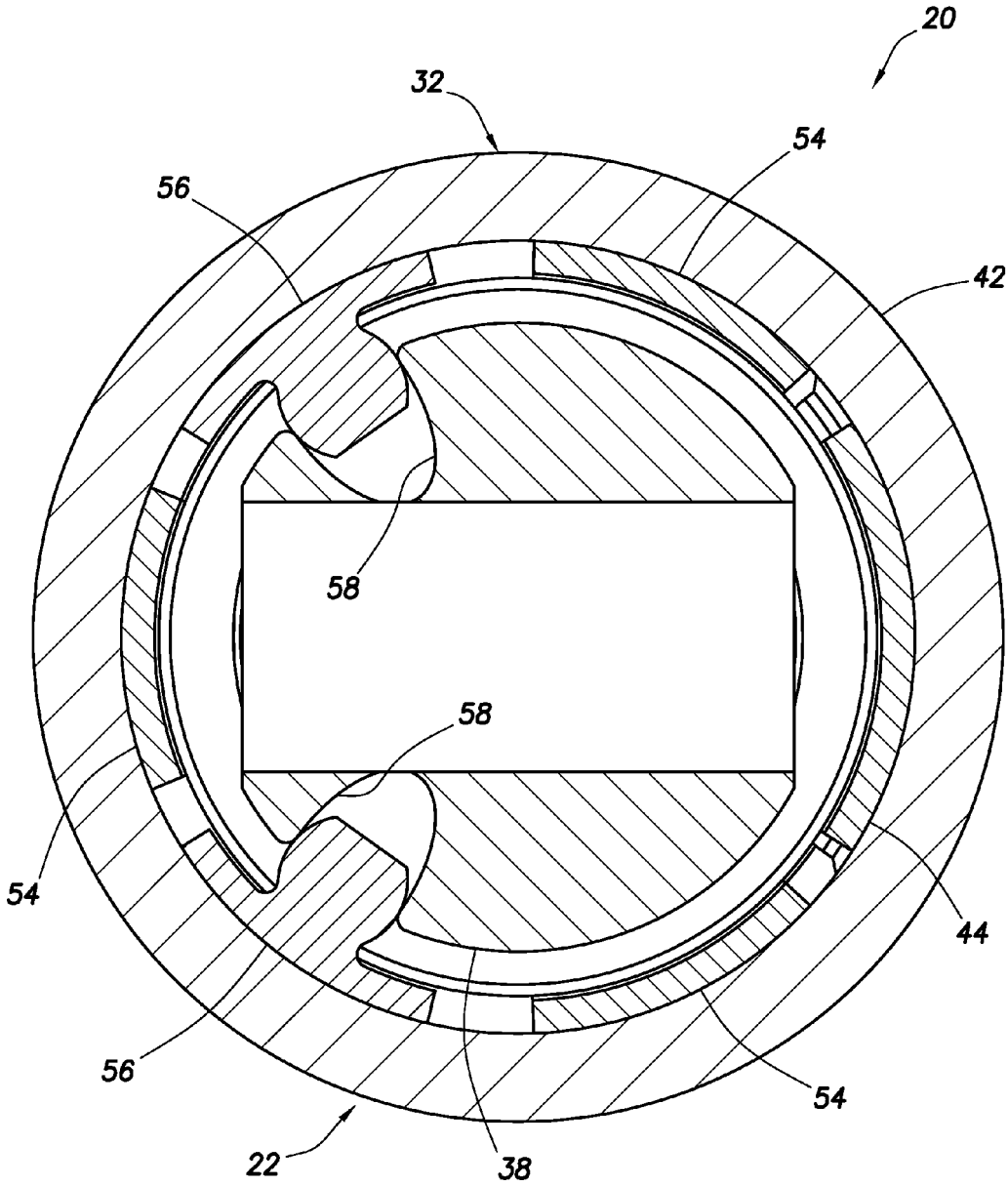
FIG. 7 is a further enlarged scale schematic cross-sectional view of a ball valve of the well tool, taken along line 7-7 of FIG. 4B.

Referring additionally now to FIG. 7, a cross-sectional view of the ball valve 32 is representatively illustrated. In this view the engagement between the operating members 56 and the ball closure 38 may be more clearly seen, along with the manner in which the operating members 56, operating device 44 and members 54 are positioned in the relatively small annular space between the closure 38 and the outer housing 42. It is a substantial benefit of the configuration as depicted in FIGS. 2-7 that the operating device 44 used to transmit force from the actuator 24 to the sleeve valve 30 can extend longitudinally across the ball valve 32, adjacent the closure 38, so that the single actuator can be used effectively to operate both of the valves 30, 32.

Figure 8A:
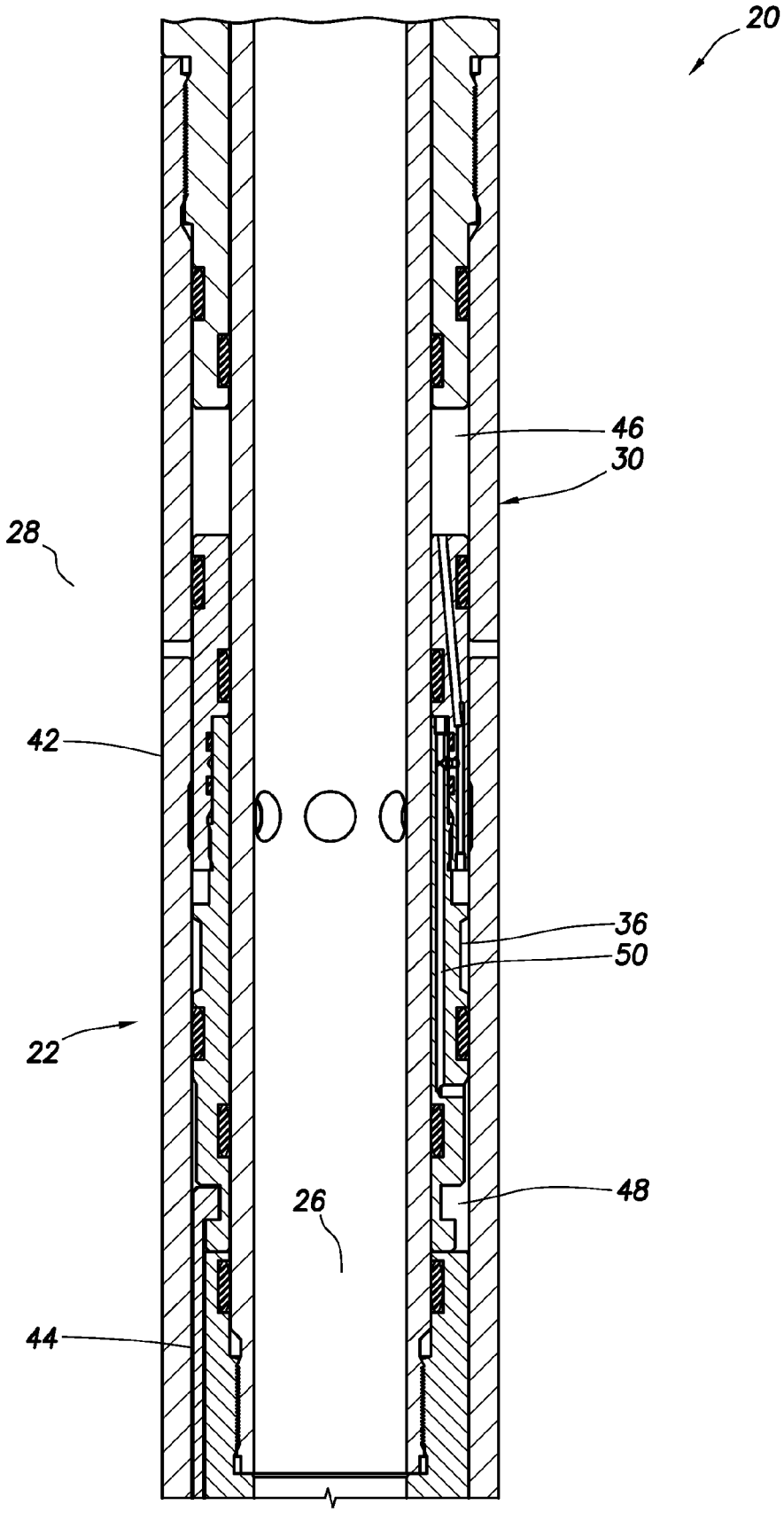
FIGS. 8A & B are schematic cross-sectional views of another construction of the well tool, with the valve section in a flow configuration.
Figure 8B:
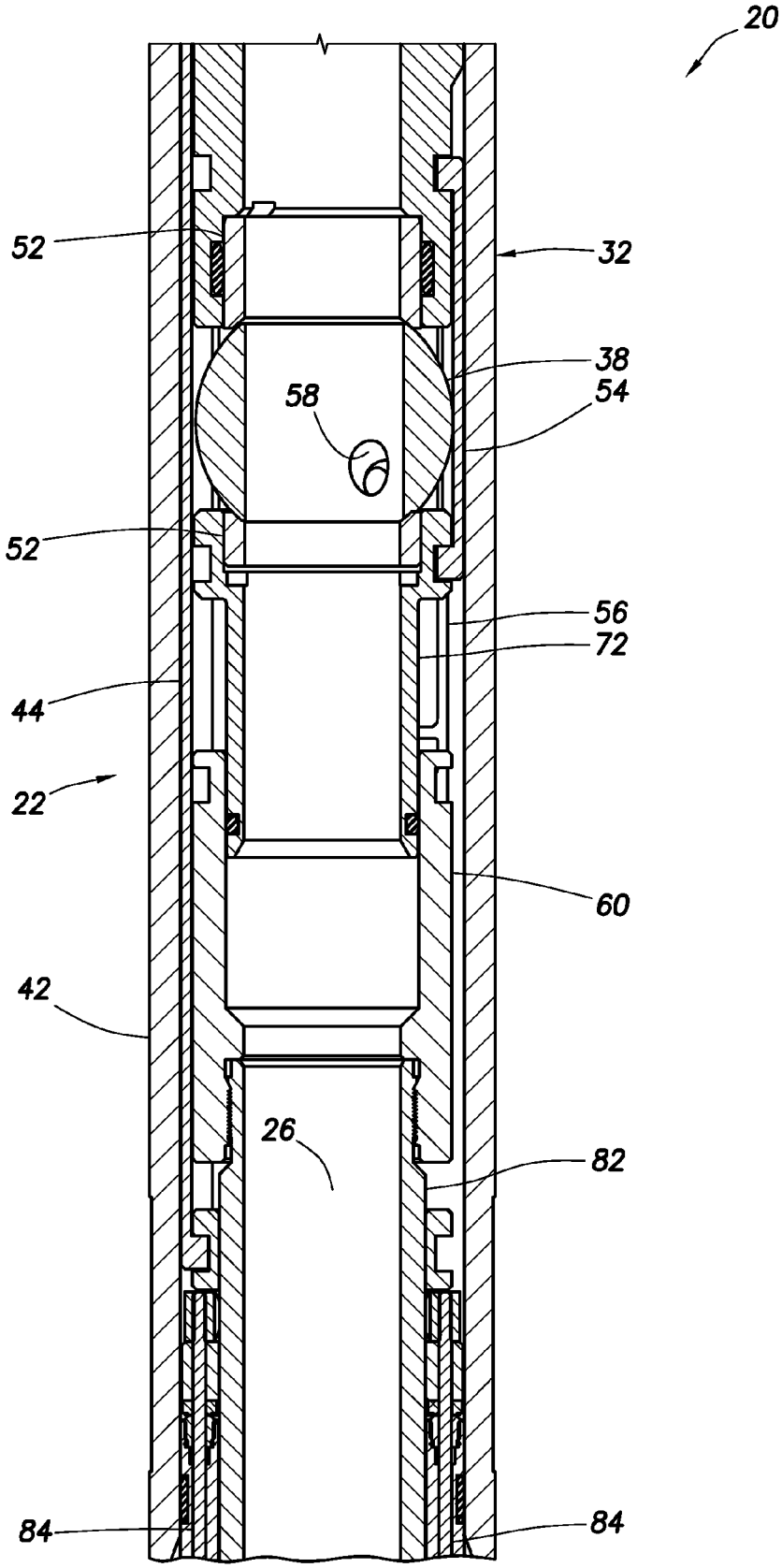

Referring additionally now to FIGS. 8A & B, another construction of the well tool 20 is representatively illustrated. In this construction, the releasable locking device 62 is not used. Instead, the valves 30, 32 are independently operated using displacement of two respective pistons of the actuator 24.

In the U.S. application Ser. No. 12/352,901 referenced above, two pistons are described for producing three separate longitudinal positions of the operating member. The pistons can be separately displaced. In the construction of FIGS. 8A & B, one of the pistons is connected to an annular-shaped operating member 82 and the other piston is connected to multiple rod-shaped operating members 84.

The operating member 82 is connected to the operating sleeve 60, and so upward and downward displacement of the operating member 82 is used to open and close the closure 38 (via the connection between the operating sleeve 60 and the operating members 56, and the connection between the operating members 56 and the ball closure 38). The operating members 84 are connected to the operating device 44, and so upward and downward displacement of the operating members 84 is used to open and close the sleeve closure 36 (via the connection between the operating device 44 and the closure 36).

As depicted in FIGS. 8A & B, the valve 30 is closed and the valve 32 is open. Thus, fluid communication is permitted through the flow passage 26, but fluid communication is prevented between the flow passage and the annulus 28 external to the valve section 22.

Figure 9A:
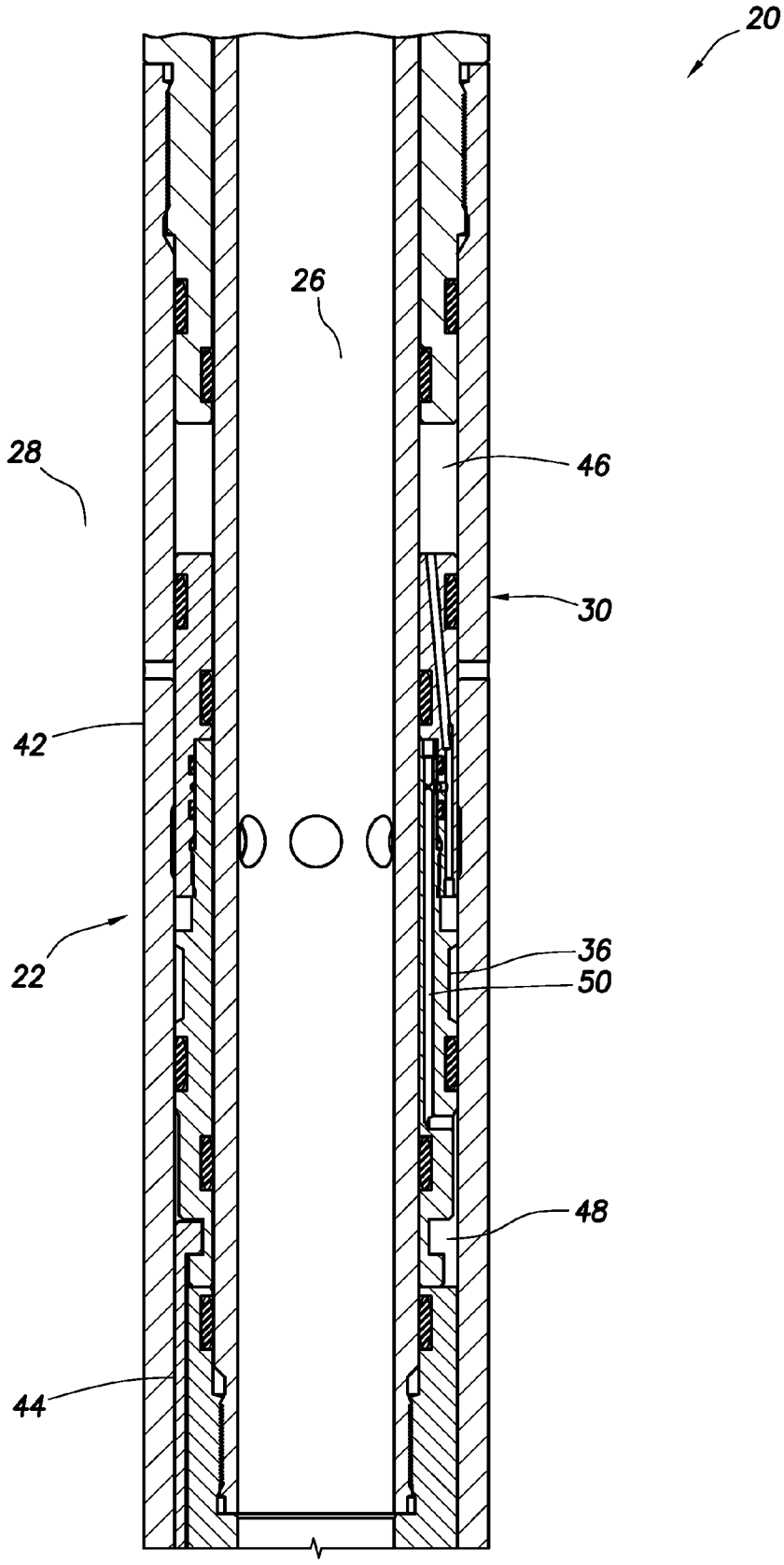
FIGS. 9A & B are schematic cross-sectional views of the valve section in a shut-in configuration.
Figure 9B:
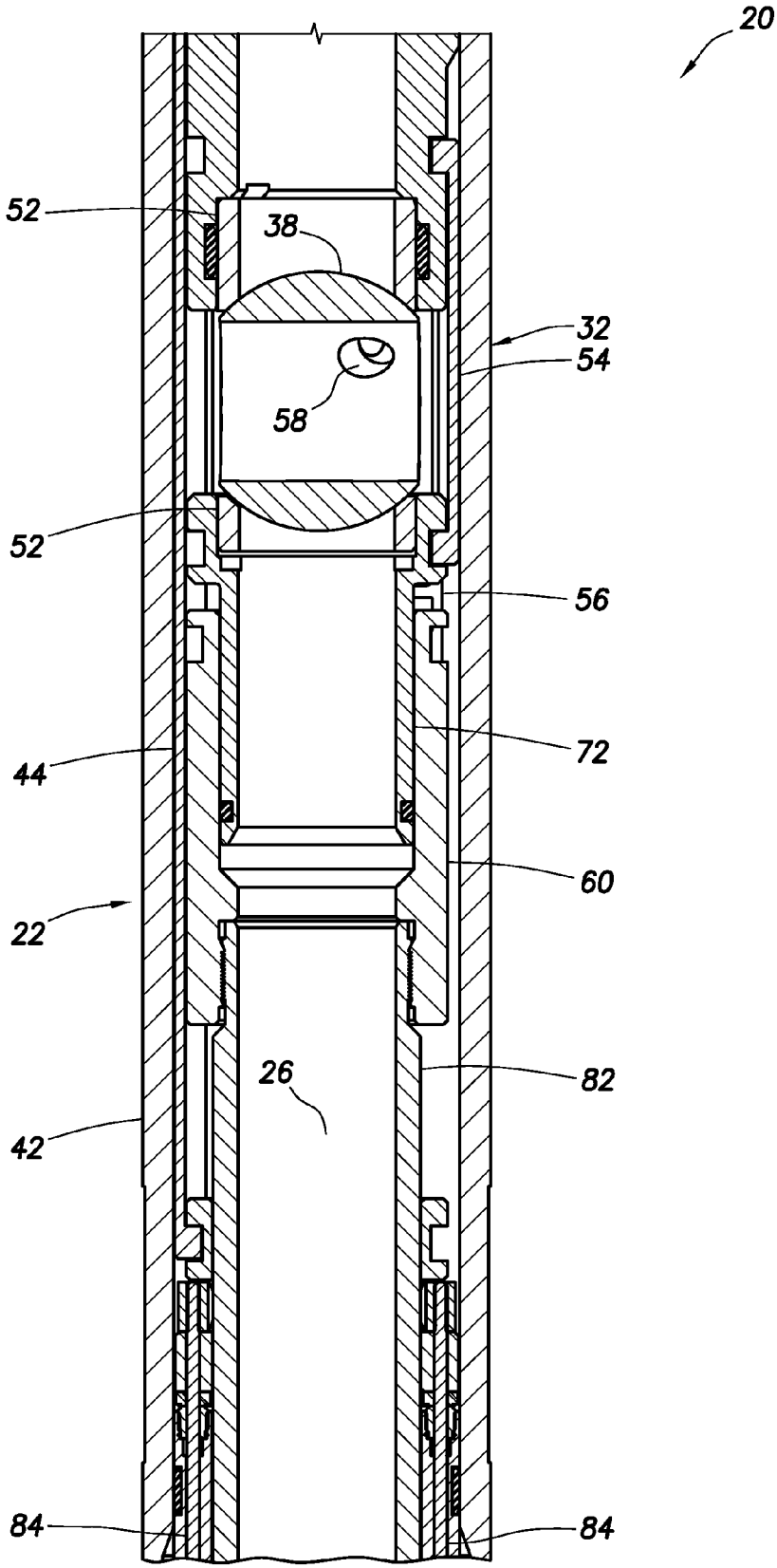

Referring additionally now to FIGS. 9A & B, the well tool 20 is representatively illustrated in a configuration in which the valve 32 has been closed due to upward displacement of the operating member 82. This upward displacement of the operating member 82 causes upward displacement of the connected operating sleeve 60 and operating members 56, thereby rotating the closure 38 to its closed position.

Note that the closure 36 has not displaced and remains in its closed position. This is due to the fact that the operating members 84 do not necessarily displace when the operating member 82 displaces.

Figure 10A:
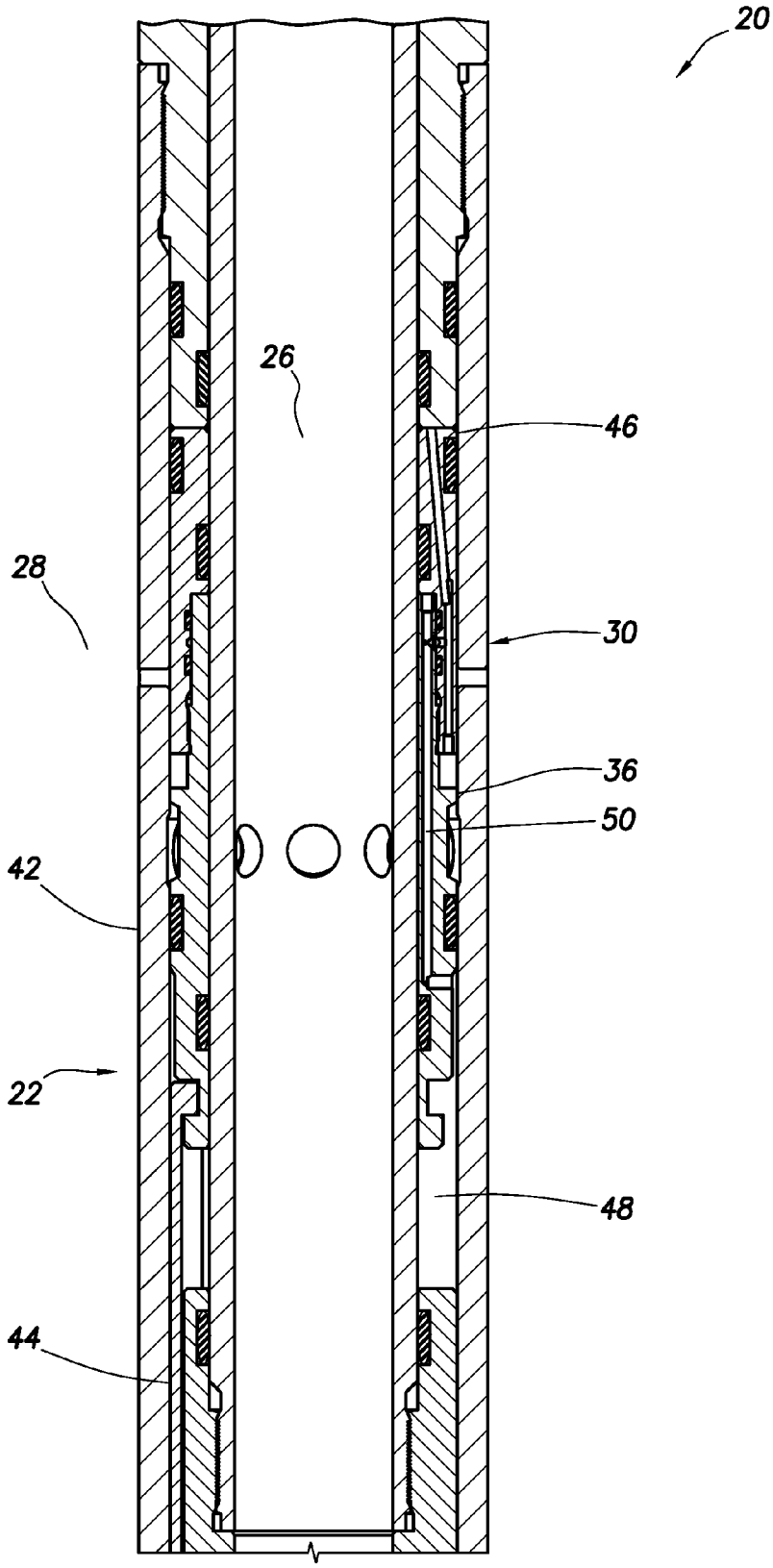
FIGS. 10A & B are schematic cross-sectional views of the valve section in a circulate configuration.
Figure 10B:
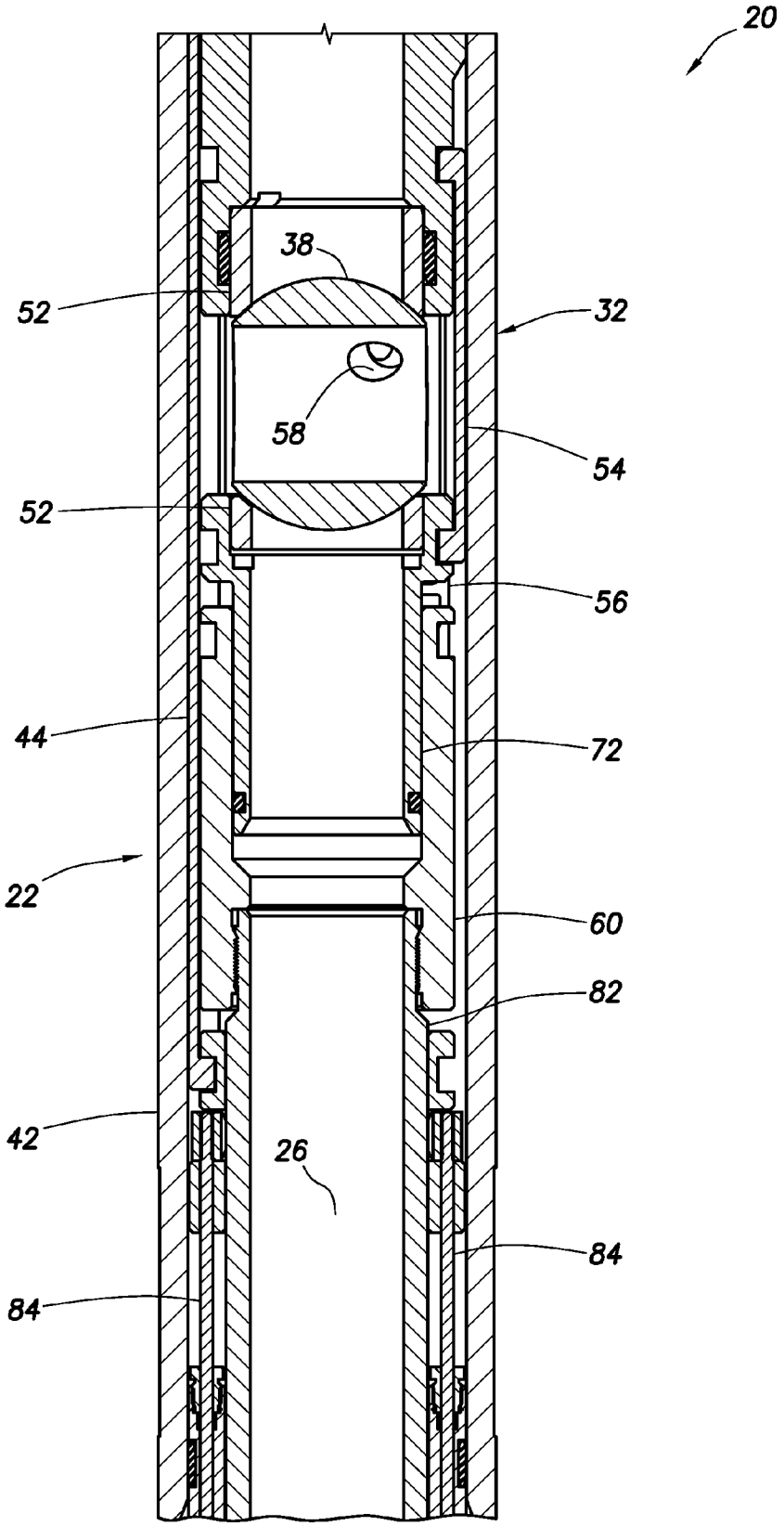

Referring additionally now to FIGS. 10A & B, the valve section 22 is representatively illustrated in a configuration in which the valve 32 remains closed, and the valve 30 is open due to upward displacement of the operating members 84. This upward displacement of the operating members 84 causes upward displacement of the operating device 44, thereby upwardly displacing the closure 36 to its open position.

The closure 38 remains in its closed position, since the operating member 82 has not displaced downward. Again, this is due to the fact that the operating member 82 does not necessarily displace when the operating members 84 displace. Thus, the pistons of the actuator 24 are used to independently operate the valves 30, 32.

Operation of the configurations of FIGS. 2-6B and FIGS. 8A-10B in reverse to that described above is by reverse order of the steps described above.

It may now be fully appreciated that the above disclosure provides many advancements to the art of operating multiple valves in wells. In the examples of the well tool 20 described above, the operating device 44 provides a mechanical connection across and through the ball valve 32 between the actuator 24 and the sleeve valve 30. No displaceable components, other than the closures 36, 38, are exposed to the flow passage 26 above the closed ball valve 32. The releasable locking device 62 in the configuration of FIGS. 2-6B provides for operation of the two valves 30, 32 using displacement of only one operating member 34 of the actuator 24.

The above disclosure describes a well tool 20 which includes at least first and second valves 30, 32 and an actuator 24 which actuates each of the first and second valves 30, 32 between open and closed configurations thereof. The second valve 32 is positioned longitudinally between the first valve 30 and the actuator 24, and the first valve 30 is operable in response to displacement of a first operating device 44 by the actuator 24.

The first operating device 44 may extend longitudinally across the second valve 32 from the actuator 24 to the first valve 30.

The second valve 32 may comprise a ball valve. The second valve 32 may be operable in response to displacement of a second operating device 76 by the actuator 24.

The well tool 20 may also include a releasable locking device 62 which releasably secures the first and second operating devices 44, 76 against displacement relative to each other. The locking device 62 may prevent relative displacement between the first and second operating devices 44, 76 when the second valve 32 is operated between its open and closed configurations. The locking device 62 may permit relative displacement between the first and second operating devices 44, 76 when the first valve 30 is operated between its open and closed configurations.

The above disclosure also describes a well tool 20 which includes a first valve 30 with a first closure 36 which displaces when the first valve 30 is operated between its open and closed configurations. A volume of a first chamber 46 increases and a volume of a second chamber 48 decreases when the first closure 36 displaces. A pressure differential between the first and second chambers 46, 48 is substantially zero when the first closure 36 displaces.

The first valve 30 may further include a passage 50 which provides fluid communication between the first and second chambers 46, 48 when the first closure 36 displaces. The passage 50 may be formed through the first closure 36.

The well tool 20 may also include a second valve 32 and an actuator 24 which actuates each of the first and second valves 30, 32 between open and closed configurations thereof. The second valve 32 may be positioned longitudinally between the first valve 30 and the actuator 24. The first valve 30 may be operable in response to displacement of a first operating device 44 by the actuator 24.

The above disclosure also describes a well tool 20 which includes an interior flow passage 26 extending through the well tool 20; a first valve 30 which selectively permits and prevents fluid communication between a first longitudinal portion 26*a* of the interior flow passage 26 and an exterior (e.g., annulus 28) of the well tool 20, the first valve 30 including a first closure 36; and a second valve 32 which selectively permits and prevents fluid communication between the first portion 26*a* and a second longitudinal portion 26*b* of the interior flow passage 26, with the second valve 32 including a second closure 38. The first and second closures 36, 38 are the only displaceable components of the well tool 20 exposed to the first flow passage portion 26*a* when the second closure 38 prevents fluid communication between the first and second flow passage portions 26*a,b*.

The well tool 20 may also include an actuator 24 which actuates each of the first and second valves 30, 32 between open and closed configurations thereof, the second valve 32 being positioned longitudinally between the first valve 30 and the actuator 24, and the first valve 30 being operable in response to displacement of a first operating device 44 by the actuator 24. The first operating device 44 may extend longitudinally across the second valve 32 from the actuator 24 to the first valve 30.

The first closure 36 may displace when the first valve 30 is operated between its open and closed configurations, and a volume of a first chamber 46 may increase and a volume of a second chamber 48 may decrease when the first closure 36 displaces. A pressure differential between the first and second chambers 46, 48 may be substantially zero when the first closure 36 displaces. The first valve 30 may further include a passage 50 which provides fluid communication between the first and second chambers 46, 48 when the first closure 36 displaces.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well tool, comprising:

at least first and second valves; and an actuator which actuates each of the first and second valves between open and closed configurations thereof, the second valve selectively permitting and preventing flow between upper and lower portions of a longitudinal flow passage of the well tool, the second valve being positioned longitudinally between the first valve and the actuator, and the first valve being operable in response to displacement of a first operating device by the actuator.

2. The well tool of claim 1, wherein the first operating device extends longitudinally across the second valve from the actuator to the first valve.

3. The well tool of claim 1, wherein the second valve comprises a ball valve.

4. The well tool of claim 1, wherein the second valve is operable in response to displacement of a second operating device by the actuator.

5. The well tool of claim 4, further comprising a releasable locking device which releasably secures the first and second operating devices against displacement relative to each other.

6. The well tool of claim 5, wherein the locking device prevents relative displacement between the first and second operating devices when the second valve is operated between its open and closed configurations.

7. The well tool of claim 6, wherein the locking device permits relative displacement between the first and second operating devices when the first valve is operated between its open and closed configurations.

8. A well tool, comprising:

a valve including a closure which displaces when the valve is operated between its open and closed configurations, the closure longitudinally separating first and second chambers, wherein a volume of the first chamber increases and a volume of the second chamber decreases when the closure displaces, wherein a pressure differential between the first and second chambers is substantially zero when the closure displaces, and wherein the valve further includes a passage which provides fluid communication between the first and second chambers when the closure displaces.

9. The well tool of claim 8, wherein the passage is formed through the closure.

10. A well tool, comprising:

a first valve including a first closure which displaces when the first valve is operated between its open and closed configurations, a volume of a first chamber which increases and a volume of a second chamber which decreases when the first closure displaces, and wherein a pressure differential between the first and second chambers is substantially zero when the first closure displaces;

a second valve; and an actuator which actuates each of the first and second valves between open and closed configurations thereof, the second valve being positioned longitudinally between the first valve and the actuator, and the first valve being operable in response to displacement of a first operating device by the actuator.

11. The well tool of claim 10, wherein the first operating device extends longitudinally across the second valve from the actuator to the first valve.

12. The well tool of claim 10, wherein the second valve comprises a ball valve having a second closure.

13. The well tool of claim 10, wherein the second valve is operable in response to displacement of a second operating device by the actuator.

14. The well tool of claim 13, further comprising a releasable locking device which releasably secures the first and second operating devices against displacement relative to each other.

15. A well tool, comprising:

an interior flow passage extending through the well tool;

a first valve which selectively permits and prevents fluid communication between a first longitudinal portion of the interior flow passage and an exterior of the well tool, the first valve including a first closure; and a second valve which selectively permits and prevents fluid communication between the first portion and a second longitudinal portion of the interior flow passage, the second valve including a second closure, and wherein the first and second closures are the only displaceable components of the well tool exposed to the first flow passage portion when the second closure prevents fluid communication between the first and second flow passage portions.

16. The well tool of claim 15, further comprising an actuator which actuates each of the first and second valves between open and closed configurations thereof, the second valve being positioned longitudinally between the first valve and the actuator, and the first valve being operable in response to displacement of a first operating device by the actuator.

17. The well tool of claim 16, wherein the first operating device extends longitudinally across the second valve from the actuator to the first valve.

18. The well tool of claim 15, wherein the first closure displaces when the first valve is operated between its open and closed configurations, wherein a volume of a first chamber increases and a volume of a second chamber decreases when the first closure displaces, and wherein a pressure differential between the first and second chambers is substantially zero when the first closure displaces.

19. The well tool of claim 18, wherein the first valve further includes a passage which provides fluid communication between the first and second chambers when the first closure displaces.

* * * * *